United States Patent [19]

Hazzard et al.

[11] Patent Number: 4,610,606

[45] Date of Patent: Sep. 9, 1986

[54] GAS REFRIGERANT COMPRESSOR INCLUDING PORTED WALLS AND A PISTON OF UNITARY CONSTRUCTION HAVING A DOMED TOP

[75] Inventors: Preston C. Hazzard, Watauga; Chris N. Hazzard, Bedford, both of Tex.

[73] Assignee: HCH Development, Inc., Dallas, Tex.

[21] Appl. No.: 638,245

[22] Filed: Aug. 6, 1984

[51] Int. Cl.[4] ..... F04B 27/04; F04B 39/10; F16J 1/00

[52] U.S. Cl. ..... 417/273; 417/490; 92/148; 92/177; 91/491

[58] Field of Search ..... 417/273, 489, 490, 238; 92/72, 89, 177, 148, 187, 13.41; 91/491–493, 495

[56] References Cited

U.S. PATENT DOCUMENTS

| | | | |
|---|---|---|---|
| 368,090 | 8/1887 | Hinds | 92/240 X |
| 858,617 | 7/1907 | Mowry | 91/481 |
| 1,750,170 | 3/1930 | Frisch | 417/238 |
| 1,914,622 | 6/1933 | Smith | 91/482 |
| 2,106,488 | 1/1938 | McCune | 417/490 X |
| 2,710,137 | 6/1955 | Arnouil | 417/490 X |
| 2,985,358 | 5/1961 | Lee et al. | 417/490 |
| 2,989,227 | 6/1961 | Statham | 417/238 |
| 3,216,355 | 11/1965 | Wanner | 92/13.41 X |
| 3,695,150 | 10/1972 | Salzmann | 92/187 X |
| 3,871,793 | 3/1975 | Olson, Jr. | 417/273 |
| 4,050,852 | 9/1977 | Brucken et al. | 417/273 |

FOREIGN PATENT DOCUMENTS

| | | | |
|---|---|---|---|
| 2708208 | 9/1977 | Fed. Rep. of Germany | 92/177 |
| 5306 | of 1914 | United Kingdom | 91/491 |

*Primary Examiner*—William L. Freeh
*Assistant Examiner*—Paul F. Neils
*Attorney, Agent, or Firm*—Harry C. Post, III

[57] ABSTRACT

A gas refrigerant compressor comprises a shaft having a first portion and an offset portion. A body supports the first portion of the shaft for rotating movement around an axis of rotation and defines a compression chamber. A compression member is adapted for reciprocating movement within the compression chamber. The compression member is connected to the offset portion of the shaft such that rotating the shaft draws gas refrigerant into the compression chamber upon movement of the compression member toward the axis of rotation and exhausts compressed gas refrigerant out of the compression chamber upon movement of the compression member away from the axis of rotation.

4 Claims, 6 Drawing Figures

GAS REFRIGERANT COMPRESSOR INCLUDING PORTED WALLS AND A PISTON OF UNITARY CONSTRUCTION HAVING A DOMED TOP

It is well known that a compressor is used in a vehicle, such as an automobile and truck, air conditioning system to compress the gas refrigerant, the operating fluid, of the vehicle air conditioning system.

Commonly, this gas refrigerant compressor is a reciprocating cross-yoke type having two members with a cylindrically shaped piston head at each end of each cross member. The cross members are joined together at the midpoint with a yoke type attachment. The four piston heads alternately move forward and backward within four compression chambers. Inlet check valves, such as reed valves, are provided at inlet ports to prevent the refrigerant from flowing into the compression chamber when the piston head is moving during the compression stroke. Outlet check valves, such as reed valves, are provided at outlet ports to prevent the refrigerant from flowing into the compression chamber when the piston head is moving during the intake stroke. A sump receives lubricating fluids from the gas refrigerant and provides the lubricating fluids to the component parts of the compressor.

The life expectancy and reliability of these prior art reciprocating refrigerant compressors and the cost are adversely effected by many factors in their design. These cross-yoke type reciprocating refrigerant compressors use too many component parts. Further, these prior art reciprocating refrigerant compressors are difficult to balance dynamically. Further, these prior art reciprocating refrigerant compressors must be installed correctly to insure correct operation of the sump. Further, these prior art reciprocating refrigerant compressors require the inlet check valves to be unseated for the lubricating fluids carried by the gas refrigerant to provide lubrication at the piston heads. Further, these prior art reciprocating refrigerant compressors require a new piston head and new compression chamber be used for larger and smaller cooling systems, which may require the prior art compressors to be totally redesigned for each system. Further, these prior art reciprocating refrigerant compressors have more bulk than desired and take up too much room in a vehicle.

Accordingly, it is an object of the present invention to provide a gas refrigerant compressor that has a greater life expectancy and reliability than prior art reciprocating refrigerant compressors.

Further, it is an object of the present invention to provide a gas refrigerant compressor constructed from fewer parts than prior art reciprocating gas refrigerant compressors.

Further, it is an object of the present invention to provide a gas refrigerant compressor that employs less parts for dynamic balancing than prior art reciprocating gas refrigerant compressors.

Further, it is an object of the present invention to provide a gas refrigerant compressor that may be mounted on a vehicle with no required orientation.

Further, it is an object of the present invention to provide a gas refrigerant compressor that eliminates the use of a separate inlet check valve.

Further, it is an object of the present invention to provide a gas refrigerant compressor that allows a single design to be used in a multiplicity of cooling systems.

Further, it is an object of the present invention to provide a gas refrigerant compressor that is more compact than prior art reciprocating gas refrigerant compressors having an equivalent output.

Further, it is an object of the present invention to provide a gas refrigerant compressor that costs the consumer less to operate and maintain than prior art reciprocating gas refrigerant compressors.

In accordance with the present invention, a gas refrigerant compressor comprises a shaft having a first portion and an offset portion. A body supports the first portion of the shaft for rotating movement around an axis of rotation and defines first, second and third compression chambers. The first, second and third compression chambers extend radially away from the axis of rotation. First, second and third compression members reciprocatingly move within the first, second and third compression chambers, respectively. Each compression member is connected to the offset portion of said shaft such that rotating the shaft draws gas refrigerant into a compression chamber upon movement of the respective compression member toward the axis of rotation and exhausts compressed gas refrigerant out of the compression chamber upon movement of the respective compression member away from the axis of rotation.

Further, in accordance with the invention, a gas refrigerant compressor comprises a shaft having a first portion and an offset portion. A body supports the first portion of the shaft for rotating movement around an axis of rotation and defines a compression chamber, a refrigerant inlet port disposed in fluid communication with the compression chamber and a refrigerant outlet port disposed in fluid communication with the compression chamber. A valve is connected to the body for preventing compressed refrigerant from passing through the refrigerant outlet port into the compression chamber. A compression member is movably disposed within the body and has a head movable within the compression chamber and an arm connected to the offset portion of the shaft to permit rotating movement around the shaft such that turning the shaft moves the compression member between an intake position, wherein the head is disposed in a position most inward of the axis of rotation allowing the refrigerant to flow through the inlet port into the compression chamber, and a compressed position, wherein the head is disposed in a position most distant from the axis of rotation allowing the refrigerant to flow out of the compression chamber through the outlet port.

Further, in accordance with the invention, a gas refrigerant compressor comprises a shaft having a first portion and an offset portion. A body supports the first portion of the shaft for rotating movement around an axis of rotation. The body has a width and defines a compression chamber, a refrigerant inlet port for carrying vapor to the compression chamber and a refrigerant outlet port for carrying vapor out of the compression chamber. A compression member is movably disposed within the body. The compression member has a head movable within the compression chamber with a length extending along the body width and an arm connected to the offset portion of the shaft permitting rotating movement around the shaft. The compression member is of unitary construction and the body and shaft are constructed from at least two parts such that the displacement of the compressor may be selectively expanded and lessened by adjusting the width of the body and by adjusting the length of said shaft.

Further, in accordance with the invention, a gas refrigerant compressor comprises a shaft constructed from at least two parts and having a first portion and an offset portion. A body supports the first portion of the shaft for rotating movement around an axis of rotation and defines first, second and third compression chambers. The first, second and third compression chambers are disposed to extend radially away from the axis of rotation with the first compression chamber disposed to extend radially away from the axis of rotation along a first radius, the second compression chamber disposed to extend radially away from the axis of rotation along a second radius and the third compression chamber disposed to extend radially away from the axis of rotation along a third radius. The first, second and third radii are displaced away from one another around the axis of rotation at an angle of approximately 120°. Each compression chamber of the body has front and back planar walls disposed in facing relationship with one another, planar side walls disposed in facing relationship with one another and a domed top with a cylindrical axis extending between the front and back walls. The front and back planar walls define an inlet port for receiving gas refrigerant at a location near the most inward position the compression member is moved toward the axis of rotation and an outlet port for exhausting the gas refrigerant at a location near the most outward position the compression member is moved away from the axis of rotation. First, second and third compression members are disposed for reciprocating movement within the first, second and third compression chambers, respectively. The body and compression members define a shaft chamber. The inlet ports are disposed through the front and back walls such that the gas refrigerant flows through the shaft chamber and around the shaft. A counterweight is connected to the shaft at a position for countering the weight of the offset portion of the shaft and the portion of the compression members connected to the shaft when the shaft is being rotated about the axis of rotation. A valve is connected to the body for preventing compressed refrigerant from passing through the refrigerant outlet port into the compression chamber. An elongated seal for preventing the passage of gas refrigerant between the compression member and the body is disposed on each said compression member to extend in the direction of the cylindrical axis. Each compression member is of unitary construction and has a head portion with a rectilinear cross section to be complimentarily disposed within the respective compression chamber and a dome with a cylindrical shape to complimentarily nest within the domed top of the compression chamber and an arm portion connected to the offset portion of the shaft such that rotating the shaft draws gas refrigerant into a compression chamber upon movement of the respective compression member toward the axis of rotation and exhausts compressed gas refrigerant out of the compression chamber upon movement of the respective compression member away from the axis of rotation.

Other objects and advantages of the invention will become apparent upon reading the following detailed description and upon reference to the drawings, wherein like reference characters are used throughout to designate like parts and in which.

Figure 1:
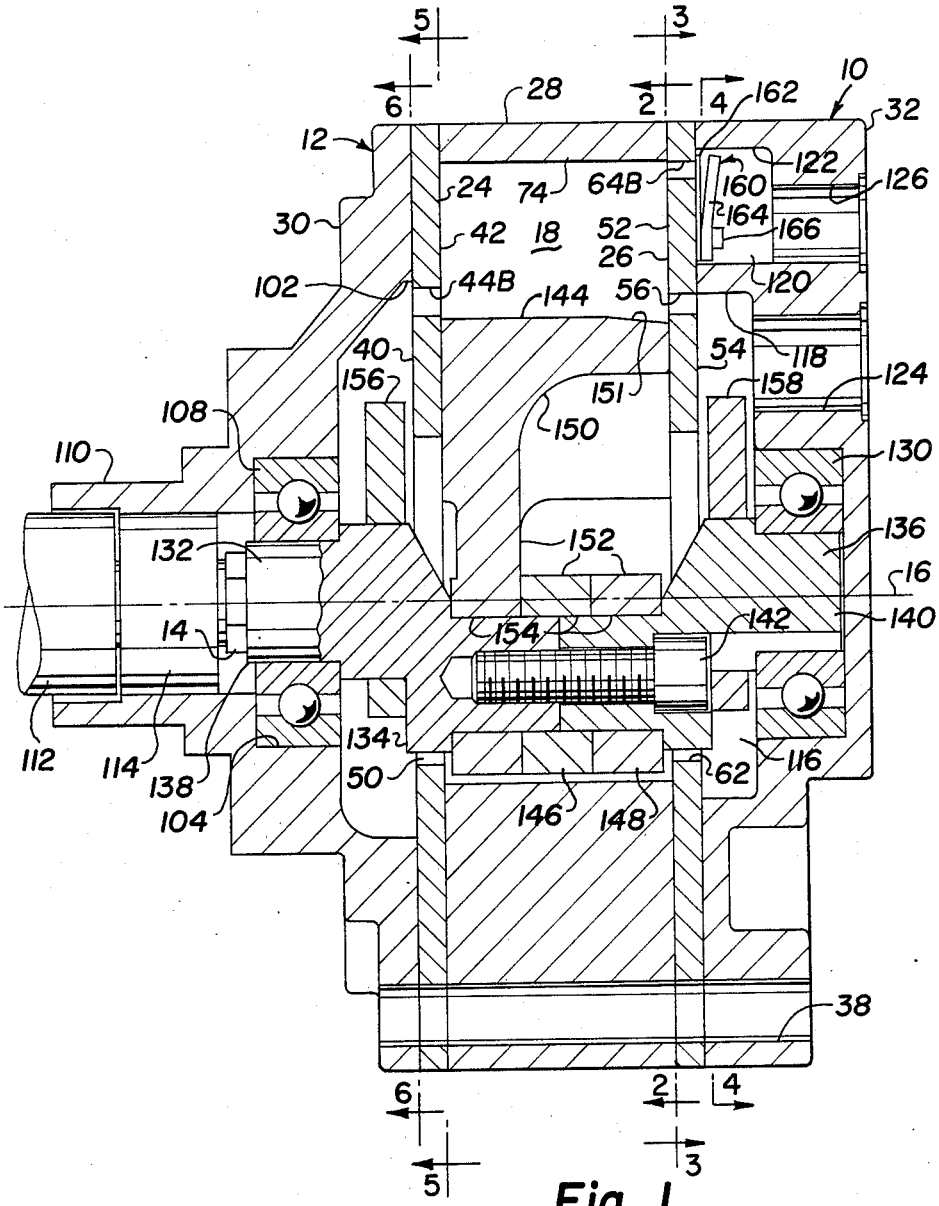
FIG. 1 is an side elevational, cross-sectional view of a preferred embodiment constructed according to the present invention.

Turning now to FIG. 1, there is shown a compressor 10 for compressing a gas refrigerant that is used in a conventional air conditioning system provided in a vehicle, such as an automobile or truck.

Figure 2:
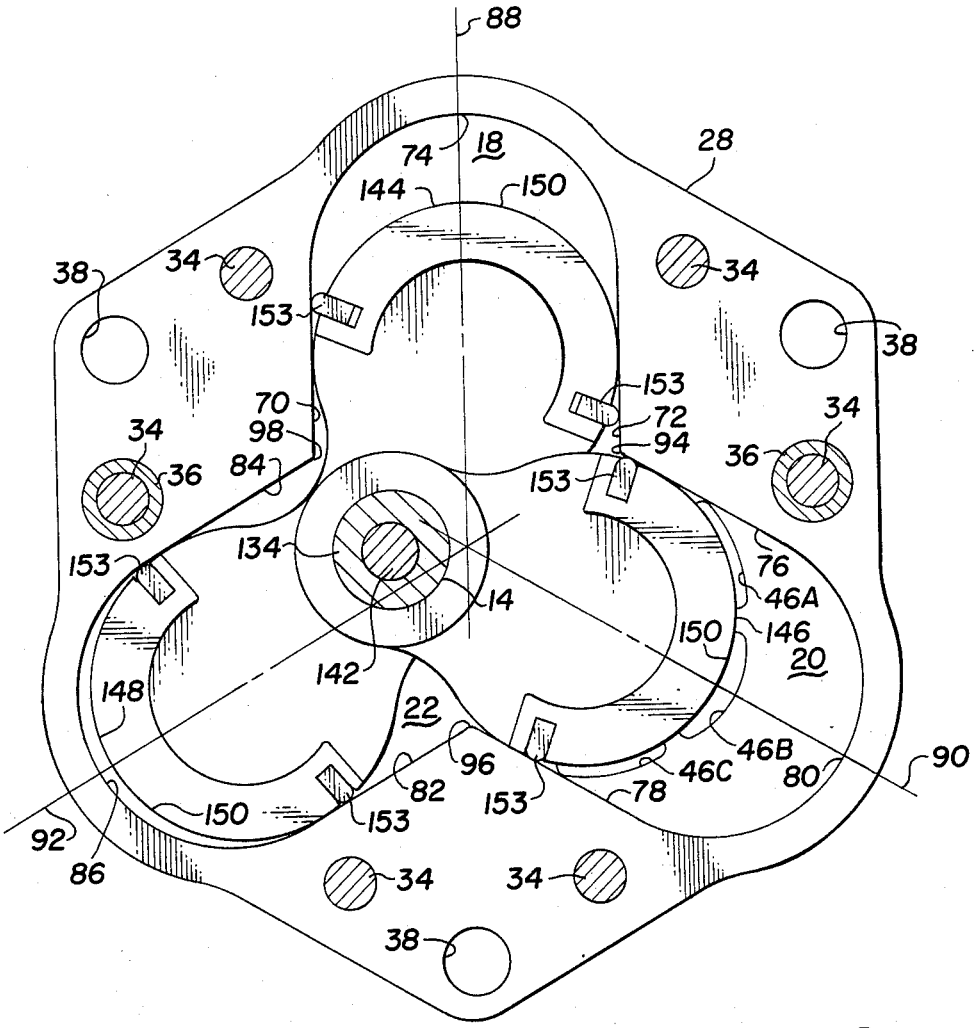
FIG. 2 is a cross-sectional view of the embodiment of the invention shown in FIG. 1, taken along lines 2—2 in the direction of the arrows toward the front and with the drive shaft rotated to illustrate a compression member at its outer most point away from the axis of rotation of the drive shaft.

As best seen in FIGS. 1 and 2, a body 12 supports a power shaft 14 for rotation around an axis of rotation 16. First compression chamber 18, second compression chamber 20 and third compression chamber 22 are defined within body 12 by walls formed by front plate 24, back plate 26 and side member 28 such that the compression chambers are generally aligned with one another around the axis of rotation, as shown in the drawings. A front cover member 30 abutts against front plate 24 and a back cover member 32 abutts against back plate 26. Front cover member 30, front plate 24, side member 28, back plate 26 and back cover member 32 are secured to one another by six connecting bolts 34. A sleeve 36 is provided in two bolt receiving apertures in body 12 to align the component parts prior to securing by bolts 34. Three mounting apertures 38 are provided through body 12 for mounting to the vehicle by conventional apparatus (not shown).

Figure 5:
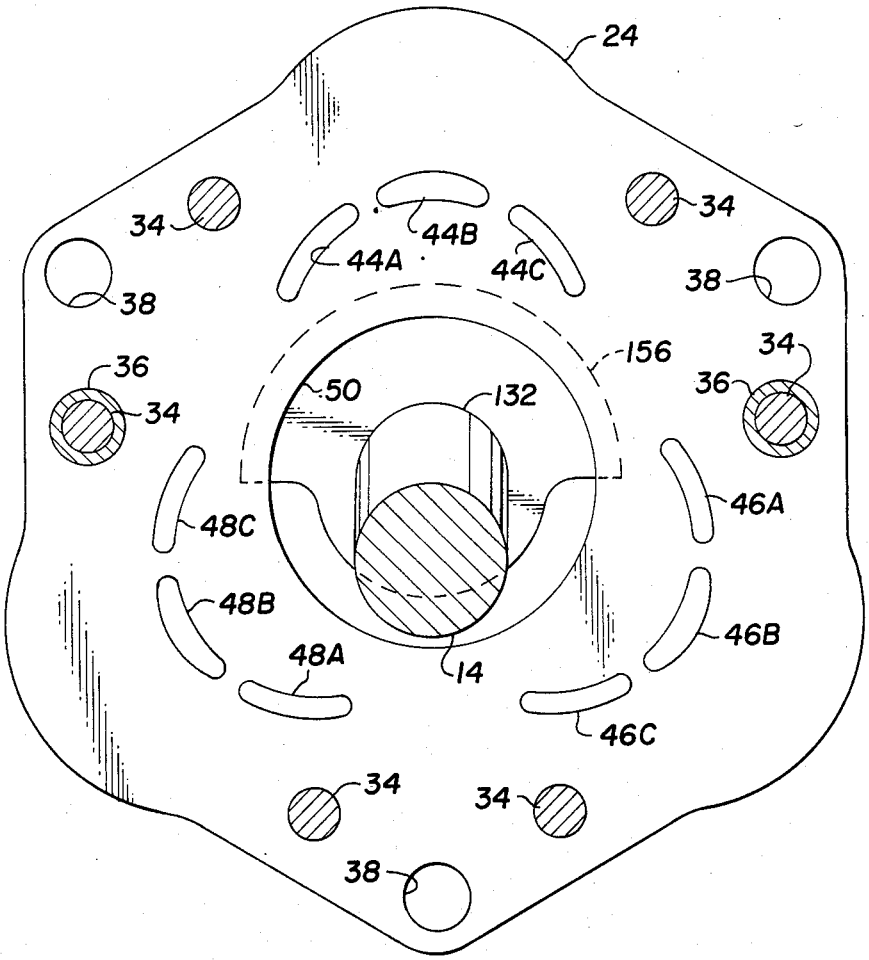
FIG. 5 is a cross-sectional view of the embodiment of the invention shown in FIG. 1, taken along lines 5—5 in the direction of the arrows toward the front.

Front plate 24 of body 12 is best seen in FIGS. 1 and 5 and has substantially planar front and back surfaces 40 and 42, respectively. Extending through plate 24 are a first series of three inlet ports 44A, 44B and 44C to permit fluid communication of the gas refrigerant with first compression chamber 18, a second series of three inlet ports 46A, 46B and 46C to permit fluid communication of the gas refrigerant with second compession chamber 20, and a second series of three inlet ports 48A, 48B and 48C to permit fluid communication of the gas refrigerant with second compression chamber 22. Each series of inlet ports in front plate 24 have substantially the same length extending along an arc formed by a radius of substantially the same length. Inlet ports 44B, 46B and 48B have substantially the same width and inlet ports 44A, 44C, 46A, 46C, 48A and 48C have substantially the same width. However, the width of inlet ports 44A, 44C, 46A, 46C, 48A and 48C are less than the width of inlet ports 44B, 46B and 48B. An aperture 50 is disposed in plate 24 concentrically about axis of rotation 16 for a distance sufficient to permit rotating movement of shaft 14.

Figure 3:
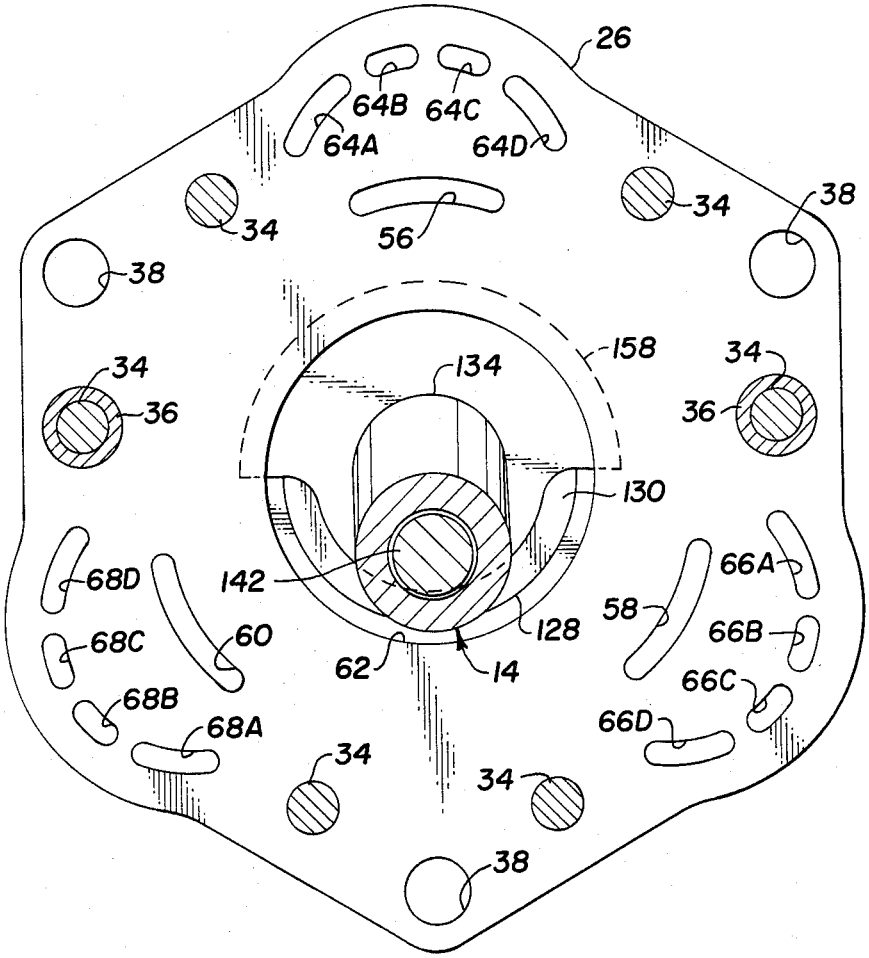
FIG. 3 is a cross-sectional view of the embodiment of the invention shown in FIG. 1, taken along lines 3—3 in the direction of the arrows toward the back.

Back plate 26 of body 12 is best seen in FIGS. 1 and 3 and has substantially planar front and back surfaces 52 and 54, respectively. Extending through back plate 26 is a first inlet port 56 to permit fluid communication of the gas refrigerant with first compression chamber 18, a second inlet port 58 to permit fluid communication of the gas refrigerant with second compression chamber 20, and a third inlet port 60 to permit fluid communication of the gas refrigerant with second compression chamber 22. Each inlet port in front plate 24 has a length extending along an arc formed by a radius of substantially the same length and substantially the same width. The edge of inlet ports 44A–C, 46A–C and 48A–C in front plate 24 and inlet ports 56, 58 and 60 in back plate 26 are approximately the same distance from axis of rotation 16. The width of first inlet port 56 is less than the width of inlet port 44B of the first series of three inlet ports 44A–C, the width of second inlet port 58 is less than the width of inlet port 46B of the second series of three inlet ports 46A–C, and the width of third inlet port 60 is less than the width of inlet port 48B of the third series of three inlet ports 48A–C. An aperture 62 is disposed in plate 26 about axis of rotation 16 for a distance sufficient to permit rotating movement of shaft 14. Also, extending through back plate 26 are a first series of outlet ports 64A, 64B, 64C and 64D to permit fluid communication of the gas refrigerant out of first compression chamber 18, a second series of outlet ports 66A, 66B, 66C and 66D to permit fluid communication of the gas refrigerant out of second compression chamber 20, and a third series of outlet ports 68A, 68B, 68C and 68D to permit fluid communication of the gas refrigerant out of third compression chamber 22. Each series of outlet ports in back plate 26 have a length extending along an arc formed by a radius of substantially the same length. Outlet ports 64A, 64D, 66A, 66D, 68A and 68D are of substantially the same length and width. Also, outlet ports 64B, 64C, 66B, 66C, 68B and 68C are of substantially the same length and width, which is less than the length and width of outlet ports 64A, 64D, 66A, 66D, 68A and 68D.

Side member 28 of body 12 is best seen in FIGS. 1 and 2, and has first planar side walls 70 and 72 facing one another and extending into a first domed top 74, second planar side walls 76 and 78 facing one another and extending into a second domed top 80, and third planar side walls 82 and 84 facing one another and extending into a third domed top 86. First side walls 70 and 72 are disposed to extend equidistant from and on each side of a first radius 88, which extends radially from axis of rotation 16. Second side walls 76 and 78 are disposed to extend equidistant from and on each side of a second radius 90, which extends radially from axis of rotation 16. Third side walls 82 and 84 are disposed to extend equidistant from and on each side of a third radius 92, which extends radially from axis of rotation 16. The length of first parallel side walls 70 and 72, second parallel side walls 76 and 78 and third parallel side walls 82 and 84 are substantially the same. Radii 88, 90 and 92 are displaced away from one another around the axis of rotation 16 at an angle of approximately 120°. Domed tops 74, 80 and 86 have a cylindrical axis positioned along radii 88, 90 and 92, respectively, which extends between the planar walls formed by front plate 24 and back plate 26. Side wall 72 extends into side walls 76 at a first side wall junction 94, side wall 78 extends into side wall 82 at a second side wall junction 96 and side wall 84 extends into side wall 70 at a third side wall junction 98. Junctions 94, 96 and 98 are displaced apart from one another by a distance sufficient to allow shaft 14 to be rotated around its axis of rotation.

Each compression chamber 18, 20 and 22 is defined in body 12 by front and back planar walls formed by plates 24 and 26 disposed in facing relationship with one another, planar side walls 70 and 72, 76 and 78, and 82 and 84, respectively, which are disposed in facing relationship with one another, and domed top 74, 80 and 86, respectively. Thus, each compression chamber has a rectilinear cross-section that may be enlarged or lessened by adjusting the width of side member 28 disposed between front plate 24 and back plate 26.

Figure 6:
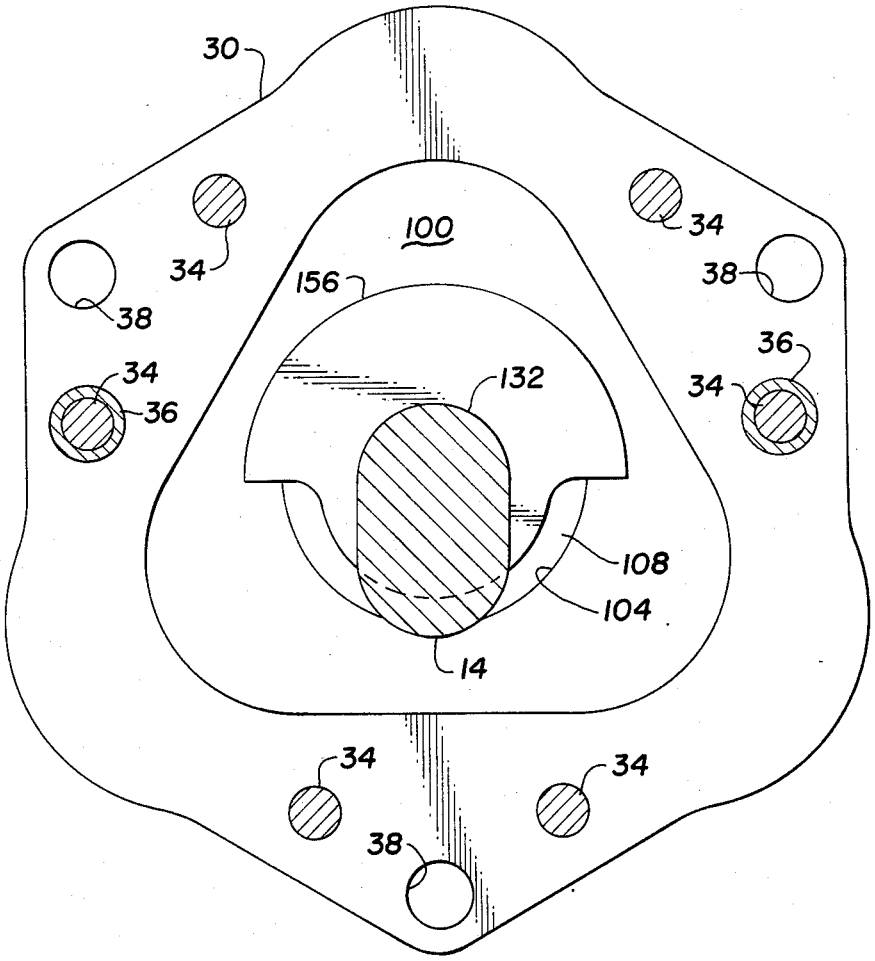
FIG. 6 is a cross-sectional view of the embodiment of the invention shown in FIG. 1, taken along lines 6—6 in the direction of the arrows toward the front.

Front cover member 30 of body 12 is best seen in FIGS. 1, 5 and 6. A generally triangularly shaped gas refrigerant inlet chamber 100 is defined by walls 102 of front cover member 30 and front surface 40 of front plate 24. Walls 102 are displaced away from one another by a distance sufficient to extend beyond inlet ports 44A–C, 46A–C and 48A–C to permit fluid communication of gas refrigerant with one another and into compression chambers 18, 20 and 22. The angles of triangularly shaped chamber 100 are of arcuate configuration which is complimentary to first series of inlet ports 44A–C, second series of inlet ports 46A–C, and third series of inlet ports 48A–C, all of which extend through front plate 24. A bearing support cavity 104 is provided in body 12 to receive a conventional roller bearing mechanism 108, which supports shaft 14 for rotating movement around axis of rotation 16. A sleeve 110 extends outwardly from front cover member 30 for receiving a shaft 112 connecting shaft 14 to a conventional drive mechanism (not shown) and a conventional seal 114 to prevent fluid communication outwardly of gas refrigerant inlet chamber 100.

Figure 4:
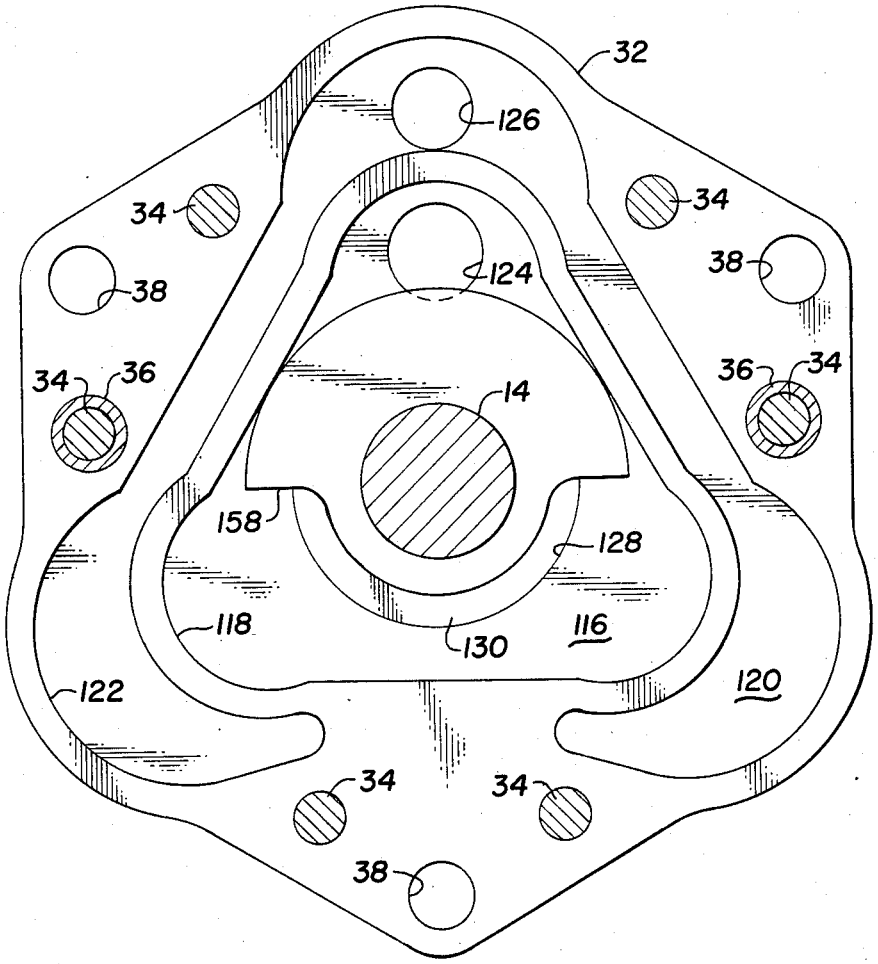
FIG. 4 is a cross-sectional view of the embodiment of the invention shown in FIG. 1, taken along lines 4—4 in the direction of the arrows toward the back.

Back cover member 32 of body 12 is best seen in FIGS. 1, 3 and 4. A generally triangularly shaped gas refrigerant inlet chamber 116 is defined by walls 118 in back cover member 32 and back surface 54 of back plate 26, and a generally triangularly shaped gas refrigerant outlet chamber 120 is defined by walls 118 and 122 of back cover member 32 and back surface 54 of back plate 26. Walls 118 are displaced apart from one another by a distance sufficient to extend beyond inlet ports 56, 58 and 60 to permit fluid communication of gas refrigerant into compression chambers 18, 20 and 22 through suction port 124, which is disposed in fluid communication with the other air conditioning apparatus (not shown) used in a vehicle. The angles of inlet chamber 116 are of arcuate configuration which is complimentary to inlet ports 56, 58 and 60 extending through back plate 26. Walls 122 are disposed outwardly of walls 118 from axis of rotation 16 so as to enclose walls 118. The angles of generally triangularly shaped outlet chamber 120 are of arcuate configuration that is complimentary to outlet ports 64A–D, 66A–D and 68A–D. These outlet ports are thus placed in fluid communication with one another and with discharge port 126, which is disposed in fluid communication with the other vehicle air conditioning apparatus (not shown). A bearing support cavity 128 provided in body 12 receives a conventional roller bearing mechanism 130, which supports shaft 14 for rotating movement around axis of rotation 16.

Power shaft 14 has a length extending between front cover member 30 and back cover member 32, passes through aperture 50 of front plate 24 and aperture 62 of back plate 26, and has a first or front portion 132, a second or offset portion 134 and a third or back portion 136. First portion 132 is adapted to be rotatably supported by bearing mechanism 108 and third portion 136 is adapted to be rotatably supported by bearing mechanism 130. The center of offset portion 134 is displaced from the center of portions 132 and 136 by a distance which is approximately one-half the distance between the bottom of inlet ports 44A–C and the wall forming domed top 74, as measured along radius 88. Power shaft 14 is constructed from a front part 138 and a back part 140, which are joined together by a headed bolt 142 extending through an opening in back part 140 with the head abutting against a shoulder in back part 140 when screwed into front part 138.

As best seen in FIGS. 1 and 2, a first compression member 144 is disposed for reciprocating movement within first compression chamber 18, a second compression member 146 is disposed for reciprocating movement within second compression chamber 20 and a third compression member 148 is disposed for reciprocating movement within third compression chamber 22. Each compression member 144, 146 and 148 is of unitary construction and has a head portion 150 with a rectilinear cross-section to be complimentarily disposed within its respective compression chamber 18, 20 and 22, and a dome of cylindrical shape to complimentarily nest within the respective domed top 74, 80 and 86 of compression chambers 18, 20 and 22. Head portion 150 has a shoulder 151 sloping from front to back toward axis of rotation 16 so as to extend slightly closer to axis of rotation 16 than the closest edges of inlet ports 56, 58 and 60. An elongated seal 153 is disposed on each side of each compression member 144, 146 and 148 to extend in the direction of the cylindrical axis of the compression members to prevent the passage of gas refrigerant between the respective compression member and the walls of the respective compression chamber defined in body 12. Also, each compression member 144, 146 and 148 has an arm portion 152 rotatably connected to offset portion 134 of shaft 14 by providing an opening 154 adapted to be slipped over offset portion 134 of shaft 14 before parts 138 and 140 are joined together by bolt 142.

As best seen in FIGS. 1, 3, 4, 5 and 6, a front counterweight 156 is secured to front portion 132 of shaft 14 and a back counterweight 158 is secured to back portion 134 of shaft 14. Counterweights 156 and 158 are made from relatively dense material and are eccentrically secured to shaft 14 so as to balance the centrifugal force generated when offset portion 134 of shaft 14 and arm portions 152 of compression members 144, 146 and 148 are rotated around axis of rotation 16.

A first valve mechanism 160 for preventing compressed refrigerant from passing through first series of refrigerant outlet ports 64A–D into first compression chamber 18 is best seen in FIG. 1. A similar valve mechanism is provided at second series of refrigerant outlet ports 66A–D into second compression chamber 20 and at third series of refrigerant outlet ports 68A–D into third compression chamber 22. Each valve mechanism 160 includes a relatively thin, flexible, impermeable, flat reed member 162 and a relatively thick, inflexible, angled support member 164, which are secured to back plate 16 by fastener 166. Reed members 162 are of sufficient size and thickness to cover outlet ports 64A–D, 66A–D and 68A–D and to permit repeated movement between an opened and closed position, the closed position being shown in FIG. 1. Support member is of sufficient size and angularly displaced from back plate 26 to allow gas refrigerant to freely flow past reed members 162 into outlet chamber 120 while preventing reed members 162 from becoming damaged when moved to the opened position.

In operation, compressor 10 is connected to a vehicle by bolts extending through mounting apertures 38. A low pressure hose of conventional vehicle air conditioning apparatus is connected by conventional apparatus at suction port 124 and a high pressure hose of the air conditioning apparatus is connected at discharge port 126. Shaft 112 of conventional rotating power providing apparatus (not shown) is connected to shaft 14. As shaft 14 is rotated around axis 16, compression members 144, 146 and 148 are reciprocatingly moved within compression chambers 18, 20 and 22. Gas refrigerant is drawn through suction port 124 into inlet chamber 116 and from there to inlet ports 56, 58 and 60, and through aperture 62 around arm portions 152 of compression members 144, 146 and 148, inlet chamber 100 and to inlet ports 44A–C, 46A–C and 48A–C. Since inlet ports 44B, 46B and 48B have a width greater than the width of inlet ports 56, 58 and 60, the inlet ports through front plate 24 open before the inlet ports thorough back plate 26 to thereby insure the flow of the lubricating fluid carrying gas refrigerant into a shaft chamber formed by head portions 150 and the side walls of side member 28 and around connecting arm portion of each compression member 144, 146 and 148. Also, gas refrigerant is forced out through through outlet ports 64A–D, 66A–D and 68A–D, around valve mechanism 160 into outlet chamber 120 and from there through discharge port 126 into the high pressure hose of the vehicle air conditioning system.

The invention having been described, what is claimed is:

1. A gas refrigerant compressor, comprising: a shaft having a first portion and an offset portion; a body supporting the first portion of said shaft for rotating movement around an axis of rotation, said body having a width and defining a compression chamber, the compression chamber of said body having front and back planar walls disposed in facing relationship with one another and planar side walls disposed in facing relationship with one another and a domed top with a cylindrical axis extending between front and back walls, a refrigerant inlet port for carrying vapor to the compression chamber and a refrigerant outlet port for carrying vapor out of the compression chamber; a compression member movably disposed within said body having a head movable within the compression chamber with a length extending along the body width and an arm connected to the offset portion of said shaft permitting rotating movement around said shaft, said compression member having a rectilinear cross section to be complimentarily disposed within the compression chamber and a dome with a cylindrical shape to complimentarily nest within the domed top of the compression chamber, said compression member being of unitary construction and said body and shaft being constructed from at least two parts, said body and said compression member defining a shaft chamber, the inlet ports being disposed through the front and back walls defining the compression chamber such that the gas refrigerant flows through the shaft chamber and around said shaft.

2. A compressor as set forth in claim 1, further comprising: seal means disposed on said compression member to extend in the direction of the cylindrical axis for preventing the passage of gas refrigerant between said compression member and said body.

3. A gas refrigerant compressor, comprising: a shaft being constructed from at least two parts and having a first portion and an offset portion; a body supporting the first portion of said shaft for rotating movement around an axis of rotation and defining first, second and third compression chambers, the first, second and third compression chambers being disposed to extend radially away from the axis of rotation, the first compression chamber disposed to extend radially away from the axis of rotation along a first radius, the second compression chamber disposed to extend radially away from the axis of rotation along a second radius, and the third compression chamber disposed to extend radially away from the axis of rotation along a third radius, the first, second and third radii being displaced away from one another around the axis of rotation at an angle of approximately 120°, each compression chamber of said body having front and back planar walls disposed in facing relationship with one another, planar side walls disposed in facing relationship with one another and a domed top with a cylindrical axis extending between the front and back walls, the front and back planar walls defining an inlet port for receiving gas refrigerant at a location near the most inward position said compression member is moved toward the axis of rotation and an outlet port for exhausting the gas refrigerant at a location near the most outward position said compression member is moved away from the axis of rotation; first, second and third compression members disposed for reciprocating movement within the first, second and third compression chambers, respectively; said body and said compression members defining a shaft chamber, the inlet ports being disposed through the front and back walls such that the gas refrigerant flows through the shaft chamber and around said shaft; counterweight means connected to said shaft at a position for countering the weight of the offset portion of said shaft and the portion of said compression members connected to said shaft when said shaft is being rotated about an axis of rotation; valve means connected to said body for preventing compressed refrigerant from passing through the refrigerant outlet port into the compression chamber; and elongated seal means disposed on each said compression member to extend in the direction of the cylindrical axis for preventing the passage of gas refrigerant between each said compression member and said body; each said compression member being of unitary construction and having a head portion with a rectilinear cross section to be complimentarily disposed within the respective compression chamber and a dome with a cylindrical shape to complimentarily nest within the domed top of the compression chamber and an arm portion connected to the offset portion of said shaft such that rotating said shaft draws gas refrigerant into a compression chamber upon movement of the respective compression member toward the axis of rotation and exhausts compressed gas refrigerant out of the compression chamber upon movement of the respective compression member away from the axis of rotation.

4. A gas refrigerant compressor, comprising: a shaft having a first portion and an offset portion; a body supporting the first portion of said shaft for rotating movement around an axis of rotation and defining a compression chamber, a refrigerant inlet port disposed in fluid communication with the compression chamber and a refrigerant outlet port disposed in fluid communication with the compression chamber; valve means connected to said body for preventing compressed refrigerant from passing through the refrigerant outlet port into the compression chamber; a compression member movably disposed within said body having a head movable within the compression chamber and an arm connected to the offset portion of said shaft permitting rotating movement around said shaft such that turning said shaft moves said compression member between an intake position, wherein the head is disposed in a position most inward of the axis of rotation allowing the refrigerant to flow through the inlet port into the compression chamber, and a compressed position, wherein the head is disposed in a position most distant from the axis of rotation allowing the refrigerant to flow-out of the compression chamber through the outlet port, the compression chamber of said body having front and back planar walls disposed in facing relationship with one another and planar side walls disposed in facing relationship with one another, and a domed top with a cylindrical axis extending between front and back walls; and said compression member having a rectilinear cross section to be complimentarily disposed within the compression chamber and a dome with a cylindrical shape to complimentarily nest within the domed top of the compression chamber, and said body and said compression member defining a shaft chamber, the inlet ports being disposed through the front and back walls defining the compression chamber such that the gas refrigerant flows through the shaft chamber and around said shaft.

* * * * *